United States Patent [19]

Golowacz

[11] 4,272,667

[45] Jun. 9, 1981

[54] ELECTRIC FLUID HEATING APPARATUS EMPLOYING STACKABLE HEAT TRANSFER MODULES

[76] Inventor: Edward Golowacz, 362 N. Central Ave., Wood Dale, Ill. 60191

[21] Appl. No.: 922,983

[22] Filed: Jul. 10, 1978

[51] Int. Cl.[3] ..... F24H 1/16; F28D 1/02

[52] U.S. Cl. ..... 219/326; 165/74; 165/162; 165/163; 219/302; 219/303; 165/104.32

[58] Field of Search ..... 219/302, 303, 304, 325, 219/326, 341; 165/162, 163, 104 R, 104 S, 107, 46, 74; 128/214

[56] References Cited

U.S. PATENT DOCUMENTS

| | | | |
|---|---|---|---|
| 389,900 | 9/1888 | Pratt et al. | 165/163 |
| 1,607,393 | 11/1926 | Derby | 219/326 X |
| 2,160,898 | 6/1939 | Peff | 165/163 X |
| 2,530,519 | 11/1950 | Guggenheim | 165/162 X |
| 2,748,249 | 5/1956 | Collerati | 219/326 X |
| 3,057,603 | 10/1962 | Isreeli | 165/74 |
| 3,244,225 | 4/1966 | Nevins | 165/162 X |
| 3,277,959 | 10/1966 | Withers | 165/162 X |
| 3,629,552 | 12/1971 | Edging | 165/107 X |
| 3,854,523 | 12/1974 | Smith et al. | 165/163 X |

FOREIGN PATENT DOCUMENTS

| | | | |
|---|---|---|---|
| 238377 | 12/1959 | Australia | 219/326 |
| 1020173 | 11/1957 | Fed. Rep. of Germany | 219/325 |
| 381064 | 9/1932 | United Kingdom | 219/326 |

*Primary Examiner*—A. Bartis

*Attorney, Agent, or Firm*—Robert H. Heise

[57] ABSTRACT

A fluid heat transfer apparatus having an expandable housing defining an enclosed interior space including fluid inlet and outlet manifolds communicating with said interior space and the exterior of said housing. The apparatus including heat transfer modules stackable in said interior space and each module comprising a flat supporting structure including upstanding elongated posts extending from one side thereof and lengths of flexible plastic tubing wound about the posts in basket-weave fashion with the ends of the tubing being connected to said inlet and outlet manifolds to provide conduction of fluid flow from said inlet to said outlet manifold. The housing being expandable to receive pluralities of said modules to selectively increase fluid heat transfer characteristic of said apparatus. The interior space being filled with a heat transfer fluid heated by a controlled heat producing medium such as electric heating elements.

15 Claims, 8 Drawing Figures

"TEMPERATURE -PRESSURE GUAGE"
"PRESSURE RELIEF VALVE"
"PRESSURE REDUCING VALVE"
ELECTRIC HEATING ELEMENTS

ELECTRIC FLUID HEATING APPARATUS EMPLOYING STACKABLE HEAT TRANSFER MODULES

BACKGROUND OF THE INVENTION

The instant invention relates to a fluid heating system which includes at least one heat transfer module by which temperature of a fluid passing therethrough is effectively controlled. The system is selectively expandable to receive a plurality of such modules wherein heat transfer characteristic may be increased through employment of substantially the same or similar system components. The modules of the system having an interchangeable and replaceable construction and comprising long lengths of inexpensive, flexible tubing, such as nylon or plastic, wound in basket-weave fashion to provide, in aggregate, a large surface area for effective heat transfer. The apparatus also features a minimal quantity of heat transfer fluid to effect rapid heat transfer and optimum efficiency.

Heretofore heat transfer systems generally employed single or multiple coils usually wound in helical fashion. Such coils are constructed of copper or other metals and thus expensive in material and labor of fabrication. Also, other systems do not provide for interchangeable and replaceable heat transfer modules or expandable systems and employ larger volume of heat transfer fluid surrounding their coils.

SUMMARY OF THE INVENTION

The present invention obviates the above-mentioned and other shortcomings by providing a fluid heat transfer system employing stackable heat transfer modules thus allowing easy replacement or expansion of the system.

The apparatus has an elongated and sealable housing defining an inner wall surface encompassing a cylindrical interior space in which the heat transfer modules are placed. The housing is adapted to be axially expanded by the use of a collar or collars which may be inserted and affixed intermediate the top and bottom of the housing. Near the bottom of the housing an annular rib which protrudes into the inner space and serves to support the lowest heat transfer module in a spaced relation to the bottom of the housing to provide a space or region directly under the lowest module. In this region is received a heat producing medium such as electric heating elements. It is also contemplated that in the event cooling of fluid is desired that such a medium could be located within the interior space at the top of the housing.

Inlet and outlet manifolds are disposed at the upper portion of the housing to provide fluid flow communication from the outside of the housing to the heat transfer modules disposed in the interior space thereof.

The heat transfer modules comprise a base plate having center circular hole and a plurality of upstanding posts disposed in concentric radial relation thereon. Flexible tubings, of nylon or plastic composition, are spirally and helically wound in a basket-weave fashion about the posts. The base plate has a plurality of perforations adjacent the posts to provide for fluid circulation therethrough and about the tubings. The tubings are wound from the base plate to near the free end of the posts, but not beyond, to allow for stacking of the modules.

The housing includes a top end plate which includes a centrally disposed cylindrical post depending therefrom. The post serves to register and retain the modules in close spaced relation to the inner surface of the housing and also displace heat transfer fluid to minimize the volume thereof.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DESCRIPTION OF THE PREFERRED EMBODIMENT

Figures 1, 3, 4, 5:
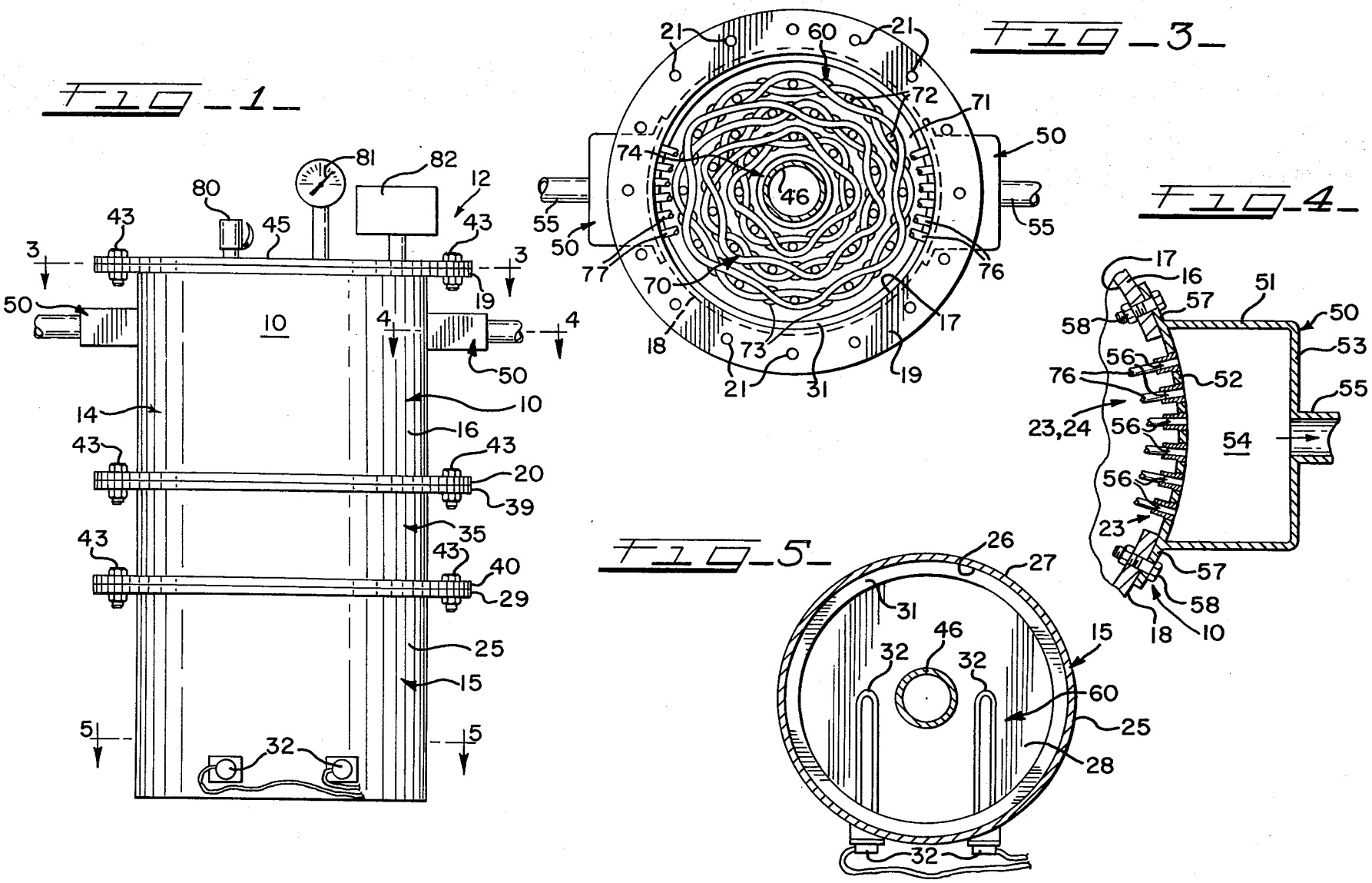
FIG. 1 is a side elevational view of the apparatus utilizing an expansion insert.
FIG. 3 is a horizontal section taken substantially on line 3—3 of the FIG. 1.
FIG. 4 is an enlarged fragmentary horizontal section of one of the manifolds taken substantially on line 4—4 of the FIG. 1.
FIG. 5 is a horizontal section taken substantially on line 5—5 of the FIG. 1.

Referring to FIG. 1, the apparatus designated 10 comprises a housing generally designated 12. The housing 12 includes top and bottom hollow cylindrical members 14 and 15 respectively.

The top member 14 of the housing 12 has a cylindrical wall section 16 defining inner and outer surfaces 17 and 18 respectively. At both the top and lower end of said section 16 are disposed flat annular flanges 19 and 20 respectively; each radially extending from the wall section 16. Each flange includes a plurality of spaced apart holes 21 and 22 located in the top and lower flanges respectively; circumferentially disposed therealong as indicated in FIG. 3. Disposed near the top of the wall section 16 and opposite each other are rectangular apertures or slots 23 and 24 which provide communication through the wall section 16.

Figure 2:
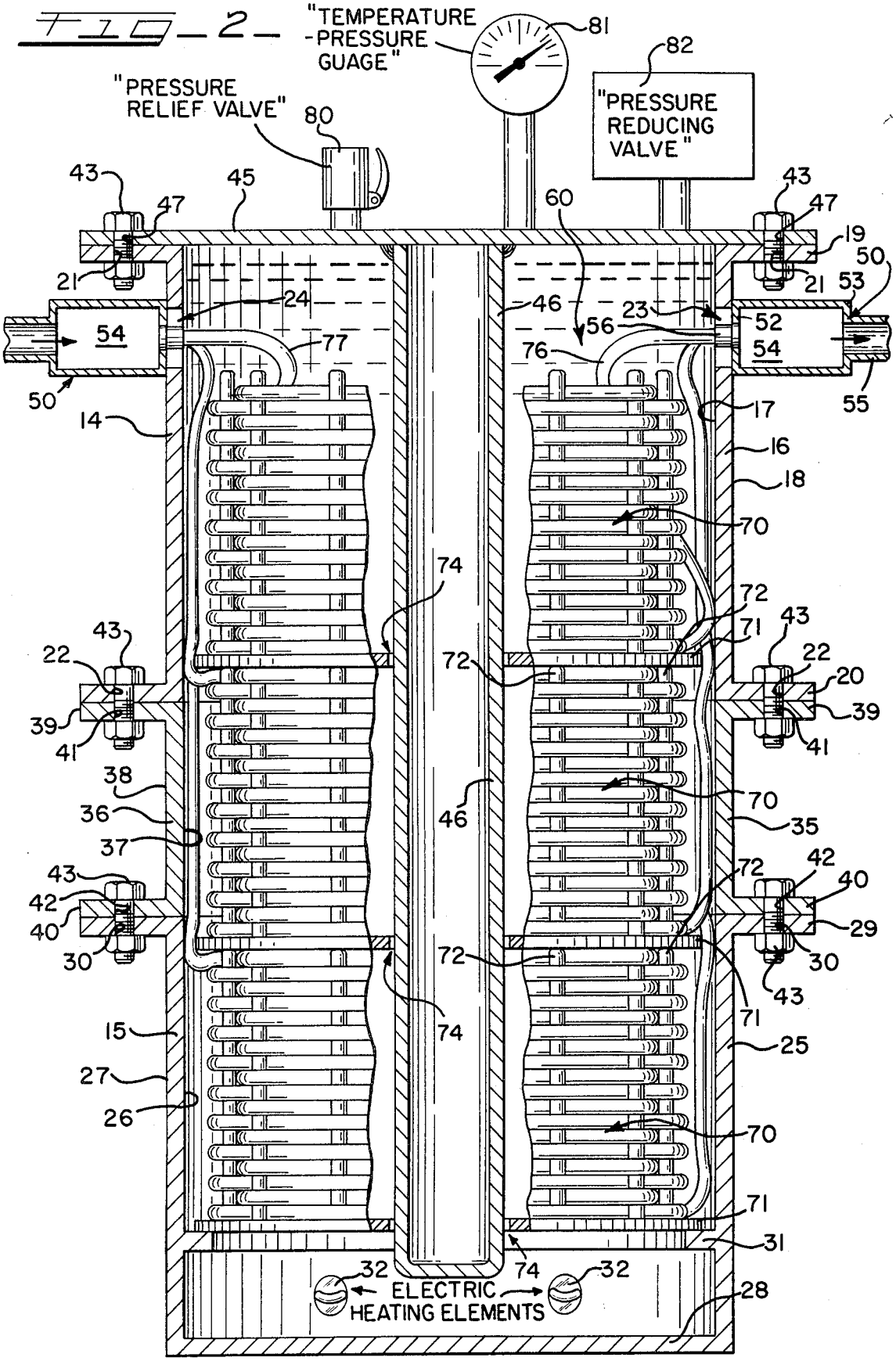
FIG. 2 is a vertical section taken through the housing of the apparatus showing heat transfer modules, with parts cut away, stacked therein.

The bottom housing member 15 comprises a cylindrical wall section 25 having inner and outer surfaces 26 and 27 respectively. The lower end of section 25 terminates at a bottom wall 28. At the top end of the wall the section 15 is disposed a flat annular flange 29. The flange 29 extends outwardly from the outer surface 27 and includes a plurality of circumferentially disposed spaced apart holes 30. As shown in FIGS. 2 and 5, an annular rib or protuberance 31 extends inwardly from the inner surface 26. This rib is spaced upward from the bottom wall 28. Between the bottom wall 28 and the rib 31 are disposed means for maintaining heat transfer fluid temperatures which may comprise heating elements 32. These heating elements 32 pass through apertures (not shown) in the lower portion of wall section 25 and are connected thereto in such a manner to effect a seal thereat. An electric heating element such as the TGA chromalox type (Manufactures designation) with sealing accessories manufactured by Emerson Electric Co. may be used. It is also contemplated that heat absorbing element could also be used.

FIGS. 1 and 2 illustrate the apparatus 10 with expansion means comprising a hollow expansion collar 35. Such a collar or a plurality of such collars are employed to selectively increase the size of the housing 12 for purposes which will be further explained hereinafter. The collar 25 comprises a cylindrical wall section 36 having inner and outer surfaces 37 and 38 respectively. Flat flanges 39 and 40 are disposed at each end of the wall section 36. Each flange extends outwardly from the outer wall surface 38. Both flanges have a plurality of holes 41 and 42, respectively, disposed in spaced circumferential relation therealong.

It should be noted that the spacing, size and disposition of the holes in flanges 19 and 20 of member 14, flange 29 of member 15 and flanges 39 and 40 of the expansion collar 35 are the same wherein when such flanges are placed in mating relation for assembly of the housing the holes aligned in order that the housing 12 may be securely bolted together. FIGS. 1 and 2 only show bolts 43 at each side of the housing. However, it is contemplated that the flanges would be bolted together via a plurality of bolts as suggested by the holes in FIG. 3 showing a plan view of flange 19.

The housing 12 also includes a circular flat top cover plate 45 which has a plurality of holes 47 circumferentially disposed adjacent to edge. These holes are of such a size and location to align with the holes 21 of the flange 19 of the top member 14 wherein cover plate 45 is securely bolted to flange 19 by a plurality of bolts as explained above. Depending from the center of the cover 45 and affixed thereto is a tube 46 having a sealed bottom.

Turning attention to FIG. 4, a manifold 50 is shown. The manifold 50 comprises an encompassing side wall 51 and front and back walls 52 and 53 respectively, thereby defining a chamber 54. A outlet pipe 55 is disposed in the back wall 53 to effect fluid flow communication with the chamber 54. The front wall 52 includes a plurality of tubing connectors 56 each of which provide fluid flow communication with the chamber 54. The side wall 51 also includes an outwardly extending lip 57 disposed adjacent the front wall 52. As seen in FIGS. 1, 2 and 3, manifolds 50 are disposed on opposite sides of the outer surface 18 of wall section 16 of the top member 14 at a location wherein the tubing connectors 56 are located within slots 23 and 24 of wall section 16. The manifolds 50 are securely fastened to the wall section 16 at the lip 57 of the manifold via bolts 58.

It is pointed out at this time that gaskets or gasket materials well known to those skilled in the art are employed to effect a sealing at all junctures of parts during assembly of the housing to provide sealed space 60 within the housing.

Figure 8:
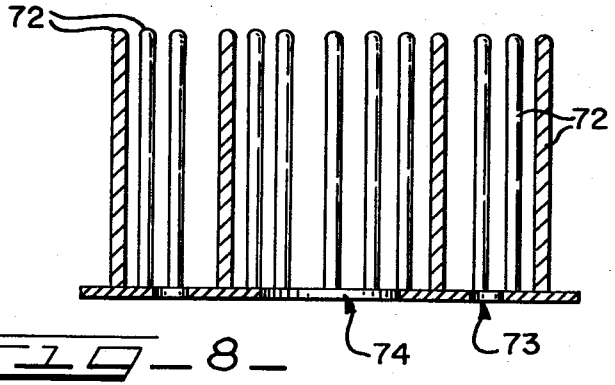
FIG. 8 is a vertical section taken substantially on line 8—8 of the FIG. 7.
Figure 7:
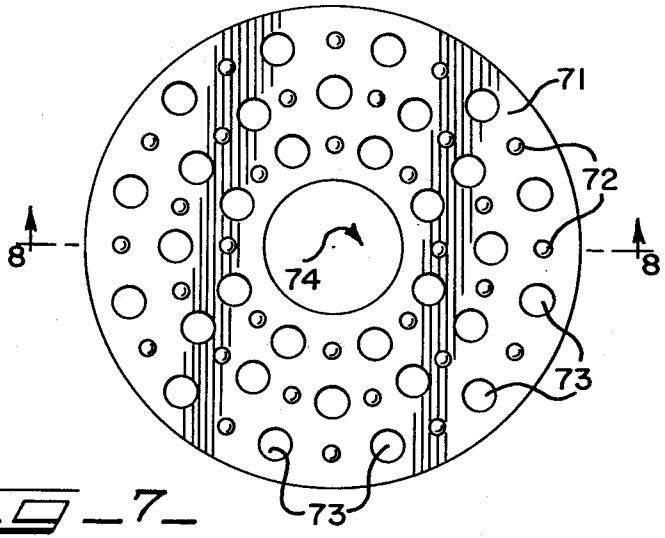
FIG. 7 is a plan view of the heat transfer module without tubing wound thereon for purposes of clarity.
Figure 6:
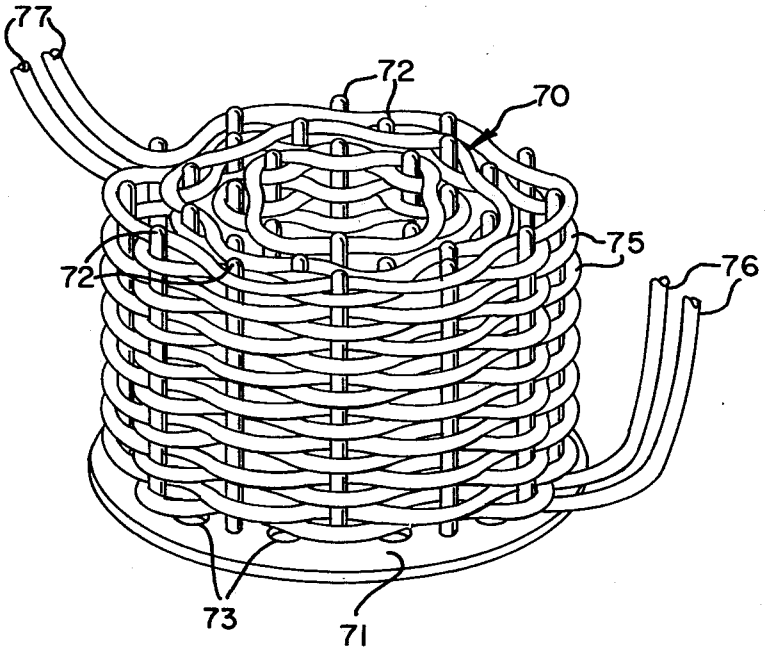
FIG. 6 is a side perspective view of a heat transfer module of the apparatus.

As best seen in FIGS. 6, 7 and 8, heat transfer means comprising module 70 of the type employed in the apparatus is shown. The module 70 comprises a supporting structure in the form base plate 71 and a plurality of elongated members in the form of upstanding posts or rods 72 disposed and affixed in concentric and radial relation thereon. The base plate 71 has a plurality of aperture or holes 73 disposed adjacent the posts 72 to provide for fluid flow through the plate 71. The plate also has a center hole 74. Flexible tubing 75 is wound in basket-weave fashion about the posts 72 and in a spiral and helical manner relative to the plate 71 to form a porous bundle of tubing substantially in the shape of the space 60. However, the tubing 75 does not pass over the center hole 74. The tubing 75 is wound in the posts 72 from the plate 71 to near the top of the posts 72, but not beyond. The tubing 75 terminates in end portions 76 and 74 which are left long enough to attach to the tubing connectors 56 of the manifolds 50. It is contemplated that the tubing 74 would be of inexpensive materials such as nylon or other plastic materials having temperature characteristics commensurate with the anticipated operating parameters of the apparatus.

During assembly of the apparatus 10, the top and bottom members 14 and 15 of the housing 12 would be bolted and sealed together at their flanges. If additional heat transfer capacity is required, one or a plurality of said collars 35 would be installed by bolting the same between the top and bottom member 14 and 15. Upon assembly the inner surfaces of the top and bottom members and any flange that may be used substantially align to provide that the space 60 is defined as a substantially cylindrical in shape. Modules 70 are placed in the space 60 with the plate 71 of the lowest module resting on the annular rib 31 of the bottom member 14. It can be seen in FIG. 2 that this lowest module is space from the bottom wall 28 to provide a space therebetween for the heating elements 32. Other such modules 50 can then be vertically stacked one on top of another wherein the top of the rods or posts 72 of a lower module engage the base plate 71 of the next module thereabove to support the same. The base plate of each module 50 is circular in shape and has a diameter slightly smaller than the inner space 60 of a dimension to allow tubings from lower modules to pass between upper modules and the inner surfaces of the housing for connection to the tubing connectors 56 of the manifolds 50. The depending tube 46 is hollow and sealed and affixed to the center of the cover plate 45 by means such as welding or the like. The tube 46 is cylindrical in shape and dimensions to slide through the center hole 74 of base plate 71 of each module 70 in such a manner as to register and retain each module in equidistant spaced relation to the inner surfaces of the housing 12. The end portions 76 and 77 of the tubings 75 of each module 70 are connected to the manifolds 50 through use of the connectors 56 provided for that purpose. The end portions 76 of each module 70 would be connected to one of the manifolds 50 and the end portions 77 of each such same modules would be connected to the other manifold whereby fluid flow conduction would be effected from one manifold through each module and then to the other manifold.

On the top cover plate 45 is also mounted devices such as a pressure relief valve 80, a temperature and pressure gauge 81, and a pressure reducing valve 82, all of which operatively communicate with the inner space 60.

In operation the inner space 60 would be filled with a heat transfer fluid such as water. The heating elements 32 would be connected to an appropriate energy source and would include thermostatic controls (not shown) to regulate the heat transfer fluid in housing and thus control quantity of heat transferred by the modules. The fluid to be heated or cooled would be forced to flow, by means of a pump (not shown) or other equipment well known in the art, from one of the manifolds through the tubings of each heat transfer module used, and out through the other manifold. The fluid holes 73 in the base plate of each module 70 allow the heat transfer fluid in the housing to circulate about the tubings to effect efficient operation of the apparatus.

It can be seen that each of the modules 70 provide a very large heat transfer surface area through the use of large quantities of tubings wound and arranged in the manner heretofore described. Furthermore, the heat transfer capacities of the apparatus can be selectively increased to adapt to a plurality of uses merely by increasing the inner space of the housing 12 and adding thereto additional modules and tube connectors to the manifolds. Also, in the event that a module clogs or otherwise malfunction, the instant apparatus features that such a module could be easily and inexpensively replaced.

It will be appreciated that the embodiments of the invention have been chosen for the purposes of illustration and description herein is that preferred based upon requirements for achieving the objects of the invention and developing the utility thereof in a most desirable manner. It will be understood, that the particular structure and functional aspect emphasized herein are not intended to exclude but rather to suggest other such modifications and adaptions as fall within spirit and scope of the invention as hereinbefore described.

What is claimed is:

1. A heat transfer apparatus for fluid comprising:

a housing having an inner side wall surface and defining an inner space having a particular shape and containing a heat transfer fluid;

an inlet fluid conducting manifold and an outlet fluid conducting manifold disposed on said housing and each of said manifolds communicating fluid flow from the outside of said housing to said inner space;

heat transfer means disposed within said housing and in said inner space for immersion in said fluid;

said heat transfer means comprising at least one module, each module having a supporting structure including elongated members extending therefrom and at least one long length of flexible tubing would about said members to form a porous volumetric shape substantially conforming to the shape of said inner space of said housing to substantially fill the same, the ends of said tubing being connected to said manifolds to provide fluid flow conduction from said inlet to said outlet manifold;

heat exchange means coupled to said inner space for maintaining said heat transfer fluid at selected temperatures and;

wherein each heat transfer module supporting structure comprises a base plate and said elongated members comprising a plurality of upstanding posts disposed on one side of said plate, and said plate having a plurality of apertures therethrough disposed adjacent said posts, and said tubing would about said posts in a basket-weave fashion.

2. The invention according to claim 1 wherein each module comprises a plurality of flexible tubings having each end thereof connected to said inlet and outlet manifolds to provide fluid flow conduction through each tubing and between said manifolds.

3. The invention according to claim 2 wherein the base plate of each module has a centrally located hole therethrough, and said housing including a centrally located member passing through said hole to register the module in said inner space in spaced relation to said inner side wall surface to provide a passage between said module and said inner side wall surface for said tubing.

4. The invention according to claim 3 wherein said heat transfer means comprises a plurality of said modules with the tubings of each thereof providing fluid flow conduction between said inlet and outlet manifolds, and the aggregate of said modules substantially filling the inner space of said module.

5. The invention according to claim 4 wherein said modules are vertically stacked one on the other within said inner space in said housing.

6. The invention according to claim 5 wherein said housing comprises a protuberance disposed at a lower portion thereof, said protuberance extending outwardly from said inner side wall into said inner space to define a lower portion of said inner space and provide a support for said modules.

7. The invention according to claim 6 wherein heat exchange means for maintaining heat transfer fluid temperatures comprises a heat producing element and said element is disposed in said lower portion of said inner space.

8. The invention according to claim 7 wherein said inlet and outlet manifolds are disposed on an upper portion of said housing.

9. An expandable heat transfer apparatus comprising:

a housing having an inner side wall surface and defining an inner space having a particular shape and containing a heat transfer fluid;

said housing including a pair of end portions and an intermediate portion, said portions being releasably joined together end to end to form said housing, said intermediate portion being selectively removeable for changing the volume of said inner space;

an inlet fluid conducting manifold and an outlet fluid conducting manifold, each mounted on outer portions of the end portions of said housing, and each said manifolds providing fluid flow communication to said inner space;

at least one heat transfer module disposed within said housing in said inner space for immersion in said fluid;

each of said modules comprising a substantially flat supporting structure including elongated members extending from one side thereof and lengths of flexible tubing wound about said members to form a bundle substantially the shape of said inner space and having a volumetric dimension to substantially fill said inner space;

said wound bundle having a porous construction to effect optimum heating conducting contact with said transfer fluid, and said tubing having end portions connected to said manifolds to provide fluid flow conduction from said inlet to said outlet manifold through said module;

heat exchange means conductively coupled to said heat transfer fluid for maintaining said fluid at selected temperatures, and;

wherein the substantially flat supporting structure of each module comprises a base plate and said elongated members of each module comprising a plurality of upstanding rods disposed on said one side of said plate, and said plate having a plurality of aperture therethrough disposed adjacent said rods, and said tubing wound about said posts in a basket-weave and helical manner to form said bundle.

10. The invention according to claim 9 wherein said base plate of each module and said housing include means to register the module in said inner space in spaced relation to said inner side wall surface to permit passage of said end portions of said tubing to said manifolds.

11. The invention according to claim 10 wherein a plurality of said modules are disposed within said housing in said inner space with the tubings of each module providing fluid flow conduction between said inlet and outlet manifolds, and the aggregate of said modules substantially filling the inner space of said module, and said modules are vertically stacked one on the other in said inner space within said housing.

12. The invention according to claim 11 wherein said housing has an upper and lower end portions and said intermediate portion comprises at least one collar selectively adaptable for disposition between said upper and lower end portions to increase said inner space of said housing to receive and stack additional said modules therein whereby heat transfer capabilities of said apparatus are increased.

13. The invention according to claim 12 wherein said housing comprises a protuberance disposed at said lower portion, said protuberance extending outwardly from said inner side wall into said inner space to define a lower portion of said inner space and provide a support for said modules.

14. The invention according to claim 13 wherein said heat exchange means for maintaining heat transfer fluid temperatures comprises a heat producing element and said element is disposed in said lower portion of said inner space.

15. The invention according to claim 14 wherein said inlet and outlet manifolds is disposed on said upper end portion of said housing.

* * * * *